US007556346B2

(12) United States Patent
Silverbrook

(10) Patent No.: US 7,556,346 B2
(45) **Date of Patent: *Jul. 7, 2009**

(54) LAMINATED PAGEWIDTH PRINTHEAD THERMAL SUPPORT ASSEMBLY

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

This patent is subject to a terminal disclaimer.

(21) Appl. No.: 12/015,434

(22) Filed: Jan. 16, 2008

(65) Prior Publication Data

US 2008/0111860 A1 May 15, 2008

Related U.S. Application Data

(63) Continuation of application No. 11/144,812, filed on Jun. 6, 2005, now Pat. No. 7,334,867, which is a continuation of application No. 10/713,065, filed on Nov. 17, 2003, now Pat. No. 6,984,021, which is a continuation of application No. 10/129,434, filed as application No. PCT/AU01/00238 on Mar. 6, 2001, now Pat. No. 6,659,590.

(30) Foreign Application Priority Data

Mar. 6, 2000 (AU) ..... PQ6059

(51) Int. Cl.
*B41J 2/155* (2006.01)
*B41J 2/14* (2006.01)
*B41J 2/16* (2006.01)

(52) U.S. Cl. ..... 347/42; 347/49

(58) Field of Classification Search ..... 347/42, 347/49

See application file for complete search history.

(56) References Cited

U.S. PATENT DOCUMENTS

| | | | |
|---|---|---|---|
| 4,750,262 | A | 6/1988 | Mahmoud et al. |
| 4,777,583 | A | 10/1988 | Minami et al. |
| 5,528,272 | A | 6/1996 | Quinn et al. |
| 5,894,316 | A | 4/1999 | Sakai et al. |
| 6,250,738 | B1 | 6/2001 | Waller et al. |
| 6,322,206 | B1 | 11/2001 | Boyd et al. |
| 6,428,145 | B1 | 8/2002 | Feinn et al. |
| 6,543,880 | B1 | 4/2003 | Akhavain et al. |

FOREIGN PATENT DOCUMENTS

| | | | |
|---|---|---|---|
| EP | 0566116 | A | 10/1993 |
| EP | 0646466 | A | 4/1995 |
| EP | 1043158 | A2 | 10/2000 |
| JP | 10-128974 | A | 5/1998 |
| JP | 10-181015 | A | 7/1998 |
| WO | WO 99/65690 | A | 12/1999 |

*Primary Examiner*—Julian D Huffman

(57) ABSTRACT

The invention provides for a pagewidth printhead thermal support assembly. The assembly includes an elongate support beam operatively supporting a plurality of printhead modules having at least one printhead integrated circuit. The support beam is comprised of a central layer with corresponding layers laminated on either side thereof, said layers laminated together so that the support beam has a coefficient of thermal expansion similar to that of silicon

6 Claims, 2 Drawing Sheets

LAMINATED PAGEWIDTH PRINTHEAD THERMAL SUPPORT ASSEMBLY

CROSS REFERENCE TO RELATED APPLICATIONS

The present application is a continuation of U.S. Ser. No. 11/144,812 filed on Jun. 6, 2005, which is a continuation of U.S. Ser. No. 10/713,065 filed on Nov. 17, 2003, now issued U.S. Pat. No. 6,984,021, which is a continuation of U.S. Ser. No. 10/129,434 filed on May 6, 2002, now issued U.S. Pat. No. 6,659,590, which is a 371 of PCT/AU01/00238 filed Mar. 6, 2001, all of which is herein incorporated by reference.

FIELD OF THE INVENTION

The present invention relates to modular printheads for digital printers and in particular to pagewidth inkjet printers.

CO-PENDING APPLICATIONS

Various methods, systems and apparatus relating to the present invention are disclosed in the following co-pending applications filed by the applicant or assignee of the present invention on 24 May 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU00/01445 filed by the applicant or assignee of the present invention on 27 Nov. 2000. The disclosures of these co-pending applications are incorporated herein by cross-reference. Also incorporated by cross-reference, is the disclosure of a co-filed PCT application, PCT/AU01/00239 (deriving priority from Australian Provisional Patent Application No. PQ6058).

BACKGROUND OF THE INVENTION

Recently, inkjet printers have been developed which use printheads manufactured by micro electro mechanical systems (MEMS) techniques. Such printheads have arrays of microscopic ink ejector nozzles formed in a silicon chip using MEMS manufacturing techniques.

Printheads of this type are well suited for use in pagewidth printers. Pagewidth printers have stationary printheads that extend the width of the page to increase printing speeds. Pagewidth printers are able to print more quickly than conventional printers because the printhead does not traverse back and forth across the page.

To reduce production and operating costs, the printheads are made up of separate printhead modules mounted adjacent each other on a support beam in the printer. To ensure that there are no gaps or overlaps in the printing, it is necessary to accurately align the modules after they have been mounted to the support beam. Once aligned, the printing from each module precisely abuts the printing from adjacent modules.

Unfortunately, the alignment of the printhead modules at ambient temperature will change when the support beam expands as it heats up to the operating temperature of the printer. Furthermore, if the printhead modules are accurately aligned when the support beam is at the equilibrium operating temperature of the printer, then unacceptable misalignments in the printing may occur before the beam reaches the operating temperature. Even if the printhead is not modularized thereby making the alignment problem irrelevant, the support beam and printhead may bow and distort the printing because of the different thermal expansion characteristics.

SUMMARY OF THE INVENTION

Accordingly, the present invention provides a printhead assembly for a printer, the printhead assembly including:

an elongate support member for attachment to the printer;

a printhead adapted to mount the support member, the printhead having and array of ink ejector nozzles formed in a substrate material; wherein, the support member is formed from a plurality of different materials having different coefficients of thermal expansion and configured such that the effective coefficient of thermal expansion of the support member is substantially equal to the coefficient of thermal expansion of the substrate material.

In some embodiments, the support member is a laminar beam with any odd number of longitudinally extending layers of at least two different materials wherein layers of the same material are symmetrically disposed about the central layer. In a particularly preferred form, the laminar beam has three longitudinally extending layers where the two outer layers are a first material and the central layer is a second material.

In other embodiments, the printhead is made up of a plurality of printhead modules adapted to mount to the support member at respective mounting points spaced along the support member; and the support member is a composite beam made up of segments of at least two different materials arranged end to end, wherein, between any two of the mounting points of the printhead modules there is at least part of at least two of the segments such that the effective coefficient of thermal expansion of the support member between the points is substantially equal to the coefficient of thermal expansion of the substrate material.

Preferably, the substrate material is silicon and the arrays of ink ejector nozzles are formed using MEMS techniques.

In some preferred forms, one of the materials is invar, and at least one of the other materials has a coefficient of thermal expansion greater than that of silicon.

It will be appreciated that the use of a composite support member made from at least two different materials having different coefficients of thermal expansion provide an effective coefficient of thermal expansion that is substantially the same as silicon.

Forming the composite beam by bonding different segments of material end to end will prevent bowing as long as the segment combinations repeat in accordance with the module mounting 'pitch' or spacing. Each combination of different materials extending between the mounting points of the printhead modules must have generally the same effective coefficient of thermal expansion as silicon. Simply ensuring that the effective coefficient of thermal expansion of the whole beam is about the same as silicon will not ensure that the modules remain aligned as the coefficient between any two adjacent mounting points may be higher or lower than silicon, thus causing misalignment.

BRIEF DESCRIPTION OF THE DRAWINGS

A preferred embodiment of the invention will now be described, by way of example only, with reference to the accompanying drawing in which.

DETAILED DESCRIPTION OF THE PREFERRED EMBODIMENT

Figure 1:
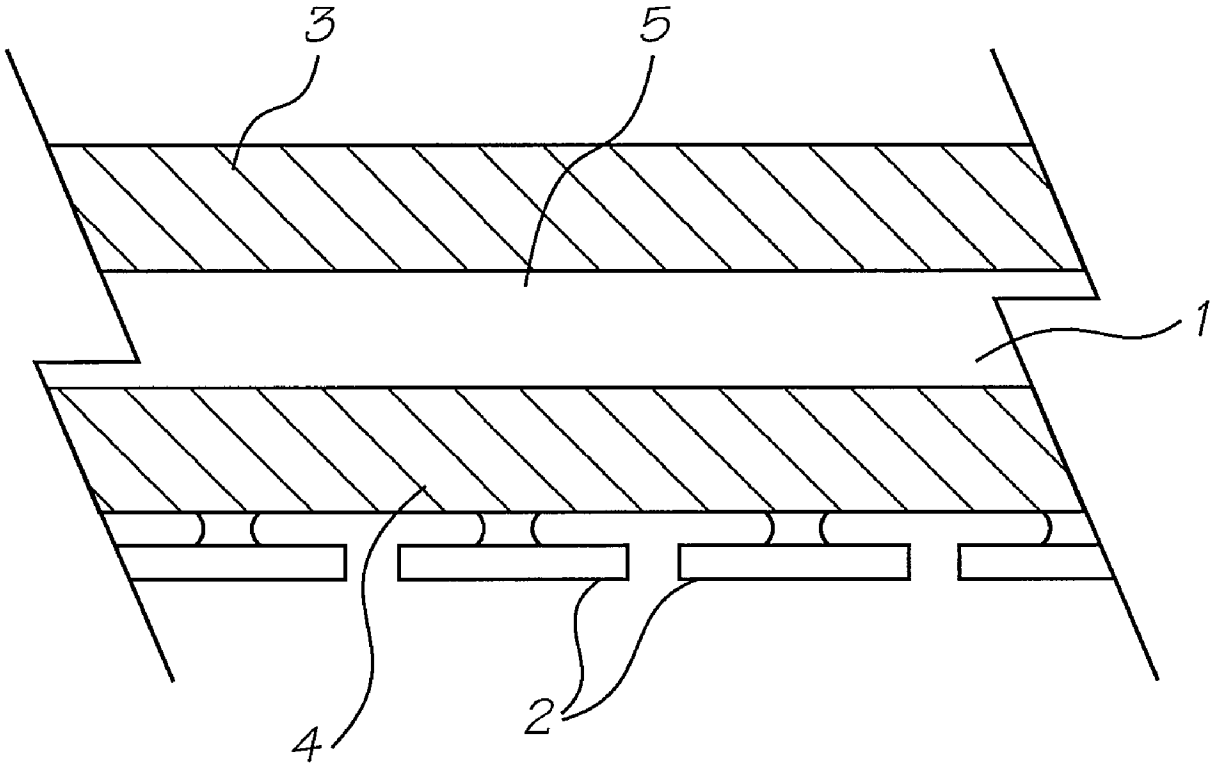
FIG. 1 is a schematic longitudinal cross section of a first embodiment of a printhead assembly according to the present invention; and, FIG. 2 is a schematic longitudinal cross section of a second embodiment of a printhead assembly according to the present invention.

Referring to FIG. 1, the printhead assembly has a support beam 1 supporting a plurality of printhead modules 2 each having a silicon MEMS printhead chip. The support beam 1 is a hot rolled three-layer laminate consisting of two different materials. The outer layers 3 and 4 are formed from invar which typically has a coefficient of thermal expansion of about $1.3\times10^{-6}$ meters per degree Celsius. The coefficient of thermal expansion of silicon is about $2.5\times10^{-6}$ meters per degree Celsius and therefore the central layer 5 must have a coefficient of thermal expansion greater than this in order to give the support beam as a whole a coefficient of thermal expansion substantially equal to that of silicon.

It will be appreciated that the effective coefficient of thermal expansion of the support beam will depend on the coefficient of thermal expansion of both metals, the Young's Modulus of both metals and the thickness of each layer. In order to prevent the beam from bowing, the outer layers 3 and 4 should be the same thickness.

Figure 2:
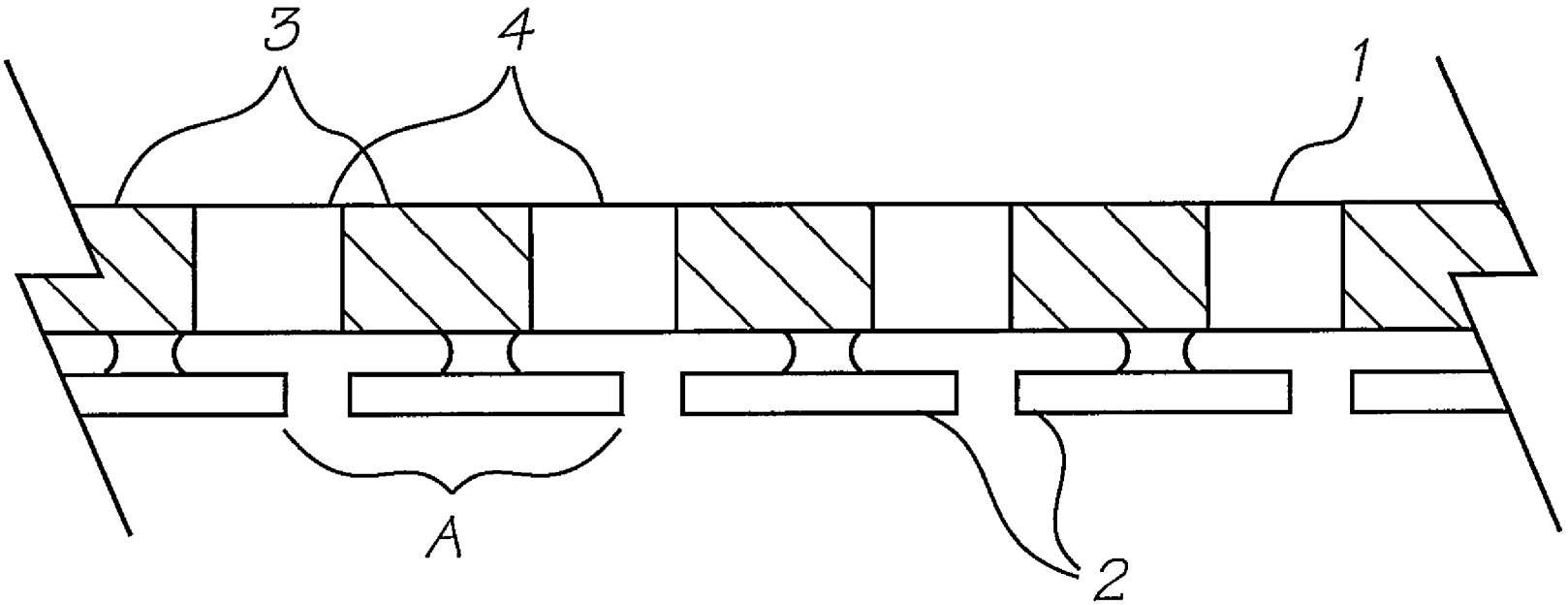

Referring to FIG. 2, the printhead assembly shown as an elongate support beam 1 supporting the printhead modules 2. Each printhead module has a silicon MEMS printhead chip.

The support beam 1 is formed from two different materials 3 and 4 bonded together end to end. Again, one of the materials has a coefficient of thermal expansion less than that of silicon and the other material has one greater than that of silicon. The length of each segment is selected such that the printhead spacing, or printhead pitch A, has an effective coefficient of thermal expansion substantially equal to that of silicon.

It will be appreciated that the present invention has been described herein by way of example only. Skilled workers in this field would recognize many other embodiments and variations which do not depart from the scope of the invention.

The invention claimed is:

1. A pagewidth printhead thermal support assembly comprising an elongate support beam operatively supporting a plurality of printhead modules having at least one printhead integrated circuit, said support beam comprised of a central layer with corresponding layers laminated on either side thereof, said layers laminated together so that the support beam has a coefficient of thermal expansion similar to that of silicon, wherein the central layer has a coefficient of thermal expansion greater than $2.5\times10^{-6}$ meters per degree Celsius, and the corresponding layers are made from Invar.

2. The printhead thermal support assembly of claim 1, including mounting points for positioning the plurality of printhead modules end to end along the beam.

3. The printhead thermal support assembly of claim 1, wherein the support beam includes two corresponding layers laminated to the central layer.

4. The printhead thermal support assembly of claim 3, wherein the corresponding layers are of the same material symmetrically disposed about the central layer.

5. The printhead thermal support assembly of claim 3, wherein the corresponding layers have a coefficient of thermal expansion of approximately $1.3\times10^{-6}$ meters per degree Celsius.

6. The printhead thermal support assembly of claim 1, having at least four corresponding layers laminated to the central layer.

* * * * *